US007990329B2

(12) United States Patent
Deng et al.

(10) Patent No.: US 7,990,329 B2
(45) Date of Patent: Aug. 2, 2011

(54) DUAL STAGGERED VERTICALLY POLARIZED VARIABLE AZIMUTH BEAMWIDTH ANTENNA FOR WIRELESS NETWORK

(75) Inventors: Gang Yi Deng, Irvine, CA (US); Bill Vassilakis, Orange, CA (US); Matthew J. Hunton, Liberty Lake, WA (US); Alexander Rabinovich, Cypress, CA (US)

(73) Assignee: Powerwave Technologies Inc., Santa Ana, CA (US)

( * ) Notice: Subject to any disclaimer, the term of this patent is extended or adjusted under 35 U.S.C. 154(b) by 469 days.

(21) Appl. No.: 12/074,980

(22) Filed: Mar. 7, 2008

(65) Prior Publication Data

US 2009/0015498 A1 Jan. 15, 2009

Related U.S. Application Data

(60) Provisional application No. 60/906,161, filed on Mar. 8, 2007.

(51) Int. Cl.
*H01Q 3/00* (2006.01)
*H01Q 21/00* (2006.01)

(52) U.S. Cl. ..... 343/757; 343/754; 343/758; 343/835; 343/766

(58) Field of Classification Search ..... None
See application file for complete search history.

(56) References Cited

U.S. PATENT DOCUMENTS

| | | | | |
|---|---|---|---|---|
| 5,274,391 | A | 12/1993 | Connolly | |
| 5,572,222 | A | 11/1996 | Mailandt et al. | |
| 5,949,303 | A | 9/1999 | Arvidsson et al. | |
| 5,969,689 | A * | 10/1999 | Martek et al. | 343/758 |
| 6,034,649 | A | 3/2000 | Wilson et al. | |
| 6,285,336 | B1 | 9/2001 | Zimmerman | |
| 6,515,633 | B2 | 2/2003 | Ippolito | |
| 6,529,172 | B2 | 3/2003 | Zimmerman | |
| 6,567,055 | B1 | 5/2003 | Oglesby | |
| 6,697,029 | B2 | 2/2004 | Teillet et al. | |
| 6,717,555 | B2 | 4/2004 | Teillet et al. | |
| 6,747,606 | B2 | 6/2004 | Harel et al. | |
| 6,756,939 | B2 | 6/2004 | Chen et al. | |
| 6,809,694 | B2 | 10/2004 | Webb et al. | |
| 6,822,618 | B2 | 11/2004 | Bisiules et al. | |
| 6,864,837 | B2 | 3/2005 | Runyon et al. | |
| 6,922,169 | B2 | 7/2005 | Izzat et al. | |
| 6,924,776 | B2 | 8/2005 | Le et al. | |
| 6,933,905 | B2 | 8/2005 | Ippolito | |

(Continued)

FOREIGN PATENT DOCUMENTS

EP 0566522 10/1993

(Continued)

OTHER PUBLICATIONS

International Search Authority, Written Opinion for International Application No. PCT/US08/03176 dated Jun. 11, 2008, 8 pages.

(Continued)

*Primary Examiner* — Trinh V Dinh

(74) *Attorney, Agent, or Firm* — OC Patent Law Group

(57) ABSTRACT

An antenna system for wireless networks having a dual stagger antenna array architecture is disclosed. The antenna array contains a number of driven radiator elements that are spatially arranged in two vertically aligned groups each having pivoting actuators so as to provide a controlled variation of the antenna array's azimuth radiation pattern.

19 Claims, 10 Drawing Sheets

U.S. PATENT DOCUMENTS

| | | | | |
|---|---|---|---|---|
| 6,950,061 | B2 | 9/2005 | Howell et al. | |
| 7,006,053 | B2 | 2/2006 | Zigler et al. | |
| 7,075,497 | B2 | 7/2006 | Teillet et al. | |
| 7,358,922 | B2 | 4/2008 | Le et al. | |
| 7,405,710 | B2 | 7/2008 | Bisiules et al. | |
| 7,710,344 | B2 * | 5/2010 | Deng et al. | 343/835 |
| 7,768,469 | B2 * | 8/2010 | Mansour et al. | 343/757 |
| 2002/0149529 | A1 | 10/2002 | Fleming et al. | |
| 2005/0219140 | A1 | 10/2005 | Browne et al. | |
| 2005/0231437 | A1 | 10/2005 | Dai et al. | |
| 2007/0146222 | A1 * | 6/2007 | Mansour | 343/757 |
| 2007/0205952 | A1 | 9/2007 | Deng et al. | |
| 2007/0241979 | A1 | 10/2007 | Yang | |
| 2009/0015498 | A1 | 1/2009 | Deng et al. | |

FOREIGN PATENT DOCUMENTS

| | | |
|---|---|---|
| EP | 1098391 | 5/2001 |
| EP | 1950832 | 7/2008 |
| WO | 2005/060045 | 6/2005 |

OTHER PUBLICATIONS

International Search Authority, Written Opinion for International Application No. PCT/US08/02845 dated Jun. 2, 2008, 7 pages.

Supplemental European Search Report pertaining to European Patent Application No. 07751869.4/PCT/2007005137 mailed Feb. 4, 2010, 8 pages.

* cited by examiner

DUAL STAGGERED VERTICALLY POLARIZED VARIABLE AZIMUTH BEAMWIDTH ANTENNA FOR WIRELESS NETWORK

The present application claims priority under 35 USC section 119(e) to U.S. Provisional Patent Application Ser. No. 60/906,161, filed Mar. 8, 2007, the disclosure of which is herein incorporated by reference in its entirety.

BACKGROUND OF THE INVENTION

1. Field of the Invention

The present invention relates in general to communication systems and components. More particularly the present invention is directed to antennas for wireless networks.

2. Description of the Prior Art and Related Background Information

Modern wireless antenna implementations generally include a plurality of radiating elements that may be arranged over a reflector plane defining a radiated (and received) signal beamwidth and azimuth scan angle. Azimuth antenna beamwidth can be advantageously modified by varying amplitude and phase of a Radio Frequency (RF) signal applied to respective radiating elements. Antenna azimuth beamwidth has been conventionally defined by Half Power Beam Width (HPBW) of the azimuth beam relative to a bore sight of such an antenna array. In such an antenna array structure, radiating element positioning is critical to the overall beamwidth control as such antenna systems rely on accuracy of amplitude and phase angle of RF signal supplied to each radiating element. This places a great deal of tolerance and accuracy on a mechanical phase shifter to provide required signal division between various radiating elements over various azimuth beamwidth settings.

Real world applications often call for an antenna array with beam down tilt and azimuth beamwidth control that may incorporate a plurality of mechanical phase shifters to achieve such functionality. Such highly functional antenna arrays are typically retrofitted in place of simpler, lighter and less functional antenna arrays, while weight and wind loading of the newly installed antenna array can not be significantly increased. Accuracy of a mechanical phase shifter generally depends on its construction materials. Generally, highly accurate mechanical phase shifter implementations require substantial amounts of relatively expensive dielectric materials and rigid mechanical support. Such construction techniques result in additional size and weight not to mention being relatively expensive. Additionally, mechanical phase shifter configurations utilizing lower cost materials may fail to provide adequate passive intermodulation suppression under high power RF signal levels.

Consequently, there is a need to provide a simpler system and method to adjust antenna beamwidth control.

SUMMARY OF THE INVENTION

In a first aspect the present invention provides an antenna for a wireless network, comprising a reflector, a first plurality of radiators pivotally coupled along a first common axis and movable relative to the reflector, and a second plurality of radiators pivotally coupled along a second common axis and movable relative to the reflector. The first plurality of radiators and the second plurality of radiators are staggered relative to each other and are configurable at different angles relative to the reflector to provide variable signal beamwidth.

In a preferred embodiment of the antenna the first and second plurality of radiators comprise vertically polarized radiator elements. The antenna preferably further comprises a first plurality of actuator couplings coupled to the first plurality of radiators and a second plurality of actuator couplings coupled to the second plurality of radiators and at least one actuator coupled to the plurality of actuator couplings. The antenna may preferably further comprise an input port coupled to a radio frequency (RF) power signal dividing—combining network for providing RF signals to the first plurality of radiators and the second plurality of radiators. A multipurpose control port is coupled to the RF power signal dividing—combining network and receives a plurality of azimuth beamwidth control signals which are provided to the actuator.

The reflector is preferably generally planar, defined by a Y-axis, a Z-axis and an X-axis extending out of the plane of the reflector, and the actuator is configured to adjust positive and negative X-axis orientation of the first plurality of radiators and the second plurality of radiators relative to the Z-axis of the reflector. The first plurality of radiators and the second plurality of radiators are each aligned vertically along their respective common axis at a predetermined distance, preferably in the range of $\frac{1}{2}\lambda$-$1\lambda$ from one another in the Z-axis direction of the reflector, where $\lambda$ is the wavelength corresponding to the operational frequency of the antenna. The first common axis and second common axis are spaced apart at a predetermined distance, preferably in the range of 0-½) in the Y-axis direction of the reflector. The first plurality of radiators and the second plurality of radiators are vertically staggered at a predetermined distance, preferably in the range of $\frac{1}{2}\lambda$-$1\lambda$ from one another in the Z-axis direction of the reflector, thereby defining a diagonal stagger distance between alternate first and second radiators. The first common axis and second common axis are preferably spaced apart an equal distance from a center axis of the reflector.

The first and second plurality of radiators may respectively comprise first and second radiator elements extending from the plane of the reflector and the first and second plurality of radiators are configurable from a first setting with the first and second radiator elements oriented parallel to each other to a second setting with the elements nonparallel to each other. For example, the first setting with the elements oriented parallel to each other may have an orientation of the elements approximately 90 degrees to the plane of the reflector corresponding to a relatively wide beamwidth setting. The second setting with the elements oriented nonparallel to each other may have an orientation of the elements away from each other corresponding to a relatively narrow beamwidth setting. For example, the second setting with the elements oriented nonparallel to each other may have an orientation of the elements approximately 20 degrees away from each other, or less, corresponding to 100 degrees and 80 degrees relative to the plane of the reflector, respectively. Alternatively, the second setting with the elements oriented nonparallel to each other may have an orientation of the elements toward each other corresponding to a very wide beamwidth setting. For example, the second setting with the elements oriented nonparallel to each other may have an orientation of the elements approximately 20 degrees toward each other, or less, corresponding to 80 degrees and 100 degrees relative to the plane of the reflector, respectively. The first and second plurality of radiator elements may additionally be configurable at different angles relative to the reflector to provide variable signal beam steering.

In another aspect the present invention provides a mechanically variable azimuth beamwidth and electrically variable elevation beam tilt antenna. The antenna comprises a reflector, a first plurality of aligned pivotal radiators coupled to corresponding first actuator couplings and the reflector, a second plurality of aligned pivotal radiators coupled to corresponding second actuator couplings and the reflector, and at least one actuator coupled to the first and second actuator couplings, wherein signal azimuth beamwidth is variable based on positioning of the first plurality of aligned radiators and the second plurality of aligned radiators relative to the reflector. The antenna further comprises an input port coupled to a radio frequency (RF) power signal dividing—combining network for providing RF signals to the first plurality of radiators and the second plurality of radiators, wherein the signal dividing—combining network includes a phase shifting network for controlling elevation beam tilt by controlling relative phase of the RF signals applied to the radiators.

In a preferred embodiment the antenna further comprises a multipurpose port coupled to the actuator and signal dividing—combining network to provide beamwidth and beam tilt control signals to the antenna.

In another aspect the present invention provides a method of adjusting signal beamwidth in a wireless antenna having a first plurality of radiators pivotally coupled along a first common axis relative to a reflector and a second plurality of radiators pivotally coupled along a second common axis relative to a reflector. The method comprises adjusting the first plurality of radiators to a first angle relative to the reflector and the second plurality of radiators to a second angle relative to the reflector to provide a first signal beamwidth, and adjusting the first plurality of radiators to a third angle relative to the reflector and the second plurality of radiators to a fourth angle relative to the reflector to provide a second signal beamwidth.

In a preferred embodiment the method further comprises providing at least one beamwidth control signal for remotely controlling the angular setting of the first plurality of radiators and the second plurality of radiators. As one example, the first and second angles may be equal and the third and fourth angles are different. For example, the first and second angles may be approximately 90 degrees relative to the plane of the reflector and the third and fourth angles are greater and less than 90 degrees, respectively. For example, the third and fourth angles may be approximately 10 degrees greater and less than 90 degrees, respectively. The method may further comprise providing variable beam tilt by controlling the phase of the RF signals applied to the radiators through a remotely controllable phase shifting network.

Further features and advantages of the present invention will be appreciated from the following detailed description of the invention.

DETAILED DESCRIPTION OF THE INVENTION

Reference will be made to the accompanying drawings, which assist in illustrating the various pertinent features of the present invention. The present invention will now be described primarily in solving aforementioned problems relating to use of a plurality of mechanical phase shifters, it should be expressly understood that the present invention may be applicable in other applications wherein beamwidth control is required or desired. In this regard, the following description of a dual stagger, vertically polarized antenna array equipped with pivotable radiating elements is presented for purposes of illustration and description. Furthermore, the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

Figures 1A, 2A:
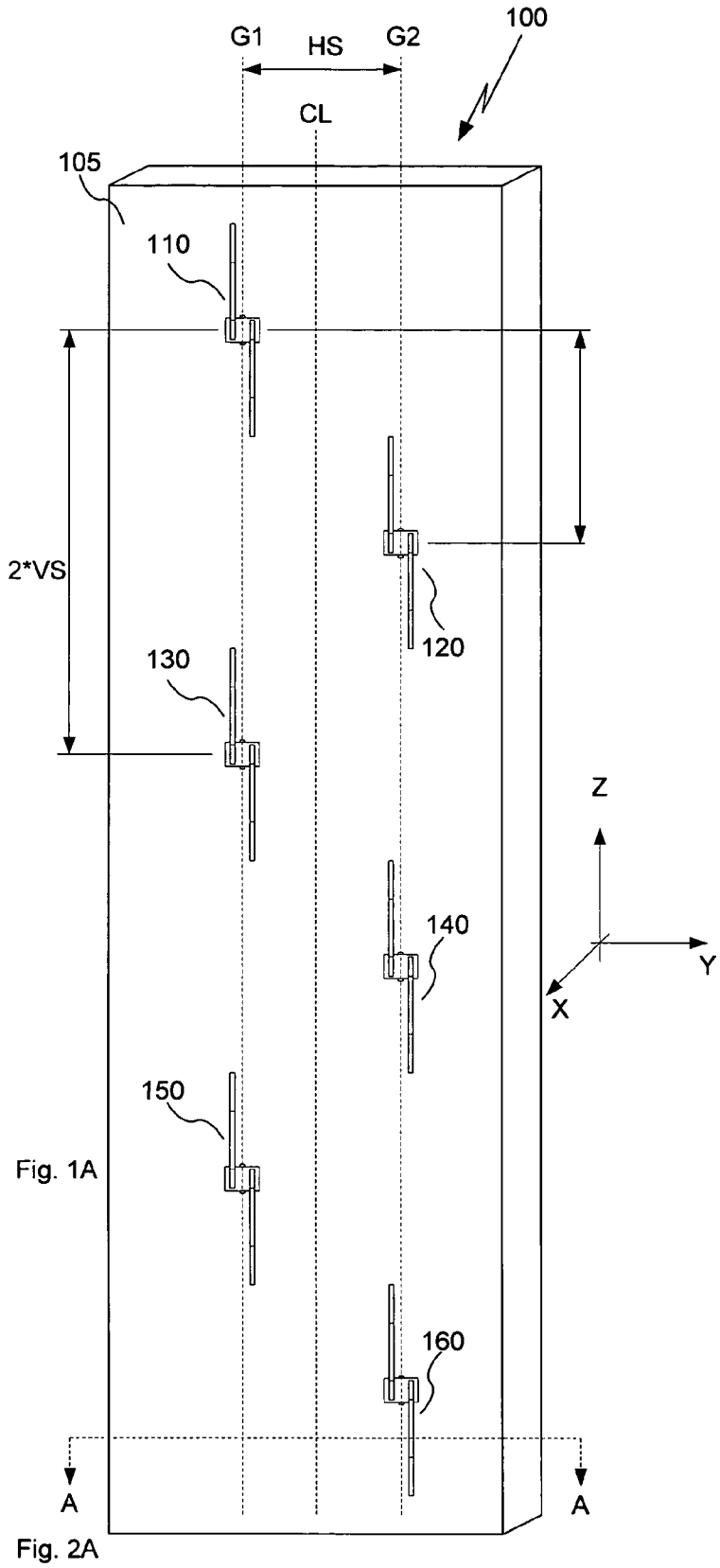
FIG. 1A illustrates a front view of a dual staggered vertically polarized antenna array in a wide azimuth beamwidth setting.
FIG. 2A illustrates a cross section along line A-A in Z-view of a dual staggered vertically polarized antenna array in a wide azimuth beamwidth setting.

FIG. 1A shows a front view of a dual stagger vertically polarized antenna array 100, according to an exemplary implementation, which utilizes a conventionally disposed reflector 105. Reflector, 105 is oriented in a vertical orientation (Z-dimension) of the antenna array. The reflector 105, may, for example, consist of an electrically conductive plate suitable for use with Radio Frequency (RF) signals. Further, reflector 105 has a plane shown as a featureless rectangle, but in actual practice additional features (not shown) may be added to aid reflector performance.

Figures 1B, 2B:
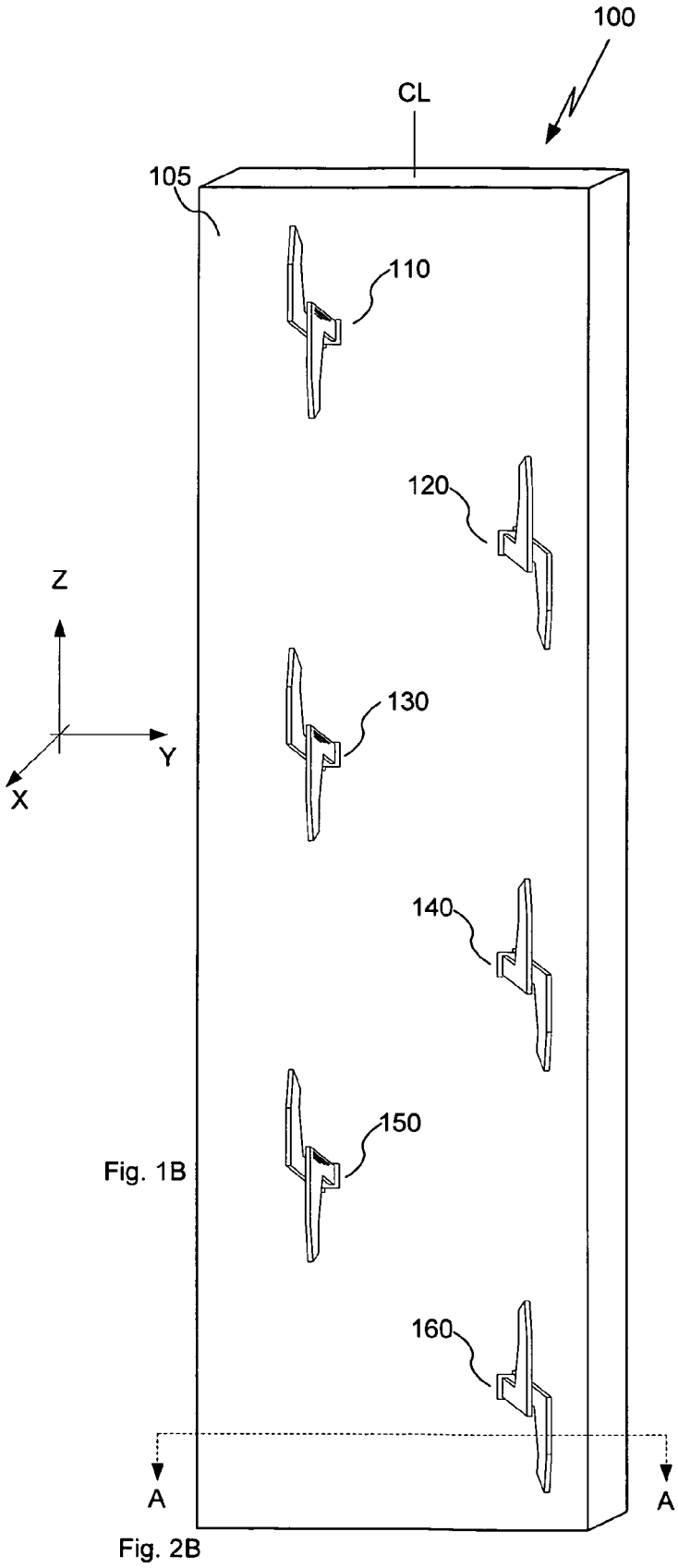
FIG. 1B illustrates a front view of a dual staggered vertically polarized antenna array in narrow azimuth beamwidth setting.
FIG. 2B illustrates a cross section along line B-B in Z-view of a dual staggered vertically polarized antenna array in a narrow azimuth beamwidth setting.

With reference to FIGS. 1A and 1B an antenna array 100 contains a plurality of RF radiators (110, 120, 130, 140, 150, 160) arranged both vertically and horizontally into two distinct vertical arrangement groups disposed on the forward facing surface of the reflector 105. In particular, the first group includes RF radiators 110, 130 and 150, while the second group includes RF radiators 120, 140 and 160. It shall be understood that additional aforementioned RF radiators may be added to each vertical arrangement groups so as to achieve desired performance. Within each vertical arrangement group (Group 1 and Group 2), RF radiators are linearly disposed along corresponding common axis labeled G1 and G2 and are separated vertically by a distance 2*VS. In one embodiment of the invention the plurality of RF radiators are separated vertically (Z direction) by a distance 2*VS. Examples of frequencies of operation in a cellular network system are well known in the art. For example, one range of RF frequencies may be between 806 MHz and 960 MHz. Alternative frequency ranges are possible with appropriate selection of frequency sensitive components. Preferably, the common axis (G1 and G2) are parallel to the vertical center axis (CL) of the reflector 105 plane and are offset in the Y direction from center axis (CL) by a distance HS/2. In one embodiment of the invention the plurality of RF radiators are separated in the Y direction by a distance HS in the range of 0-½λ from one another where λ is the wavelength of the RF operating frequency. As illustrated in FIG. 1A, common axis (G1 and G2) are equidistant from the center line (CL) of the of the reflector 105 plane. The stagger distance (SD) is defined by the following relationship:

$$SD=\sqrt{VS^2+HS^2}$$

SD should be less than 1λ. In the illustrative non-limiting implementation shown, RF reflector 105, together with a plurality of vertically polarized dipole elements forms one embodiment of an antenna array useful for RF signal transmission and reception. However, it shall be understood that alternative radiating elements, such as taper slot antenna, horn, folded dipole, and etc, can be used as well.

Figure 3A:
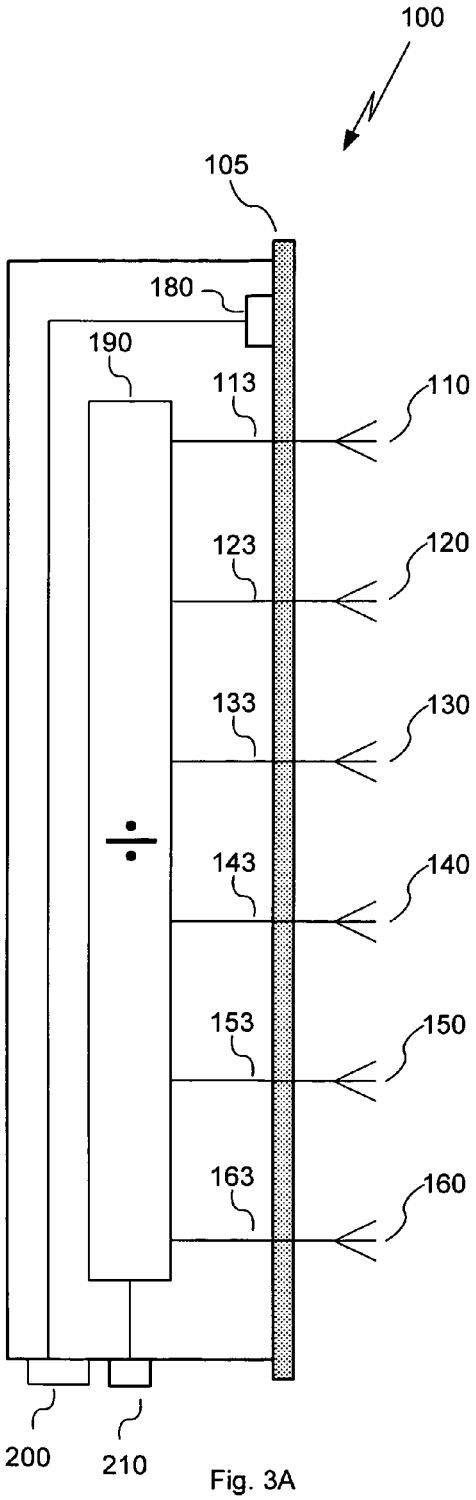
FIG. 3A illustrates a RF circuit diagram of a dual staggered vertically polarized antenna array equipped with fixed down angle tilt and remotely controllable mechanically adjustable azimuth beamwidth.
Figure 3B:
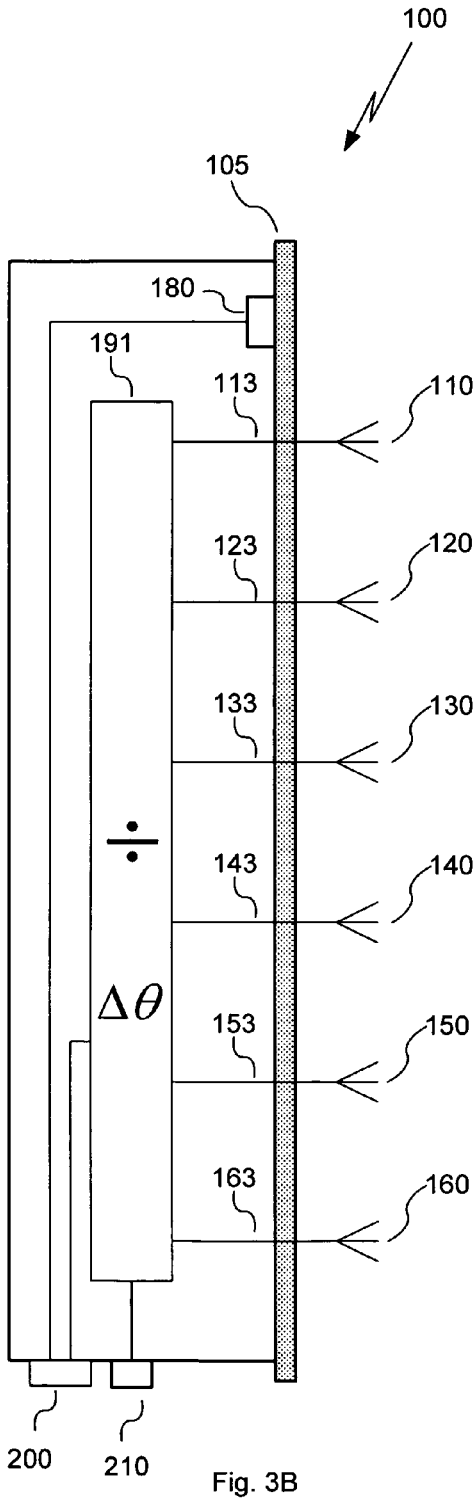
FIG. 3B illustrates a RF circuit diagram of a dual staggered vertically polarized antenna array equipped with electrically controllable beam down angle tilt and remotely controllable mechanically adjustable azimuth beamwidth.

RF radiator (110, 120, 130, 140, 150, 160) elements are fed from a single RF input port, 210, with the same relative phase angle RF signal through a conventionally designed RF power signal dividing—combining network 190. RF power signal dividing—combining network 190 output ports are coupled 113, 123, 133, 143, 153, 163 to corresponding radiating elements 110, 120, 130, 140, 150, 160. In some operational instances such RF power signal dividing—combining network 190 may include remotely controllable phase shifting network so as to provide beam tilting capability as described in U.S. Pat. No. 5,949,303 assigned to current assignee and incorporated herein by reference. An example of such implementation is shown in FIG. 3B, wherein RF signal dividing—combining network 191 provides electrical down-tilt capability. Phase shifting function of the RF power signal dividing—combining network 191 may be remotely controlled via multipurpose control port 200. Similarly, azimuth beamwidth control signals are coupled via multipurpose control port 200 to a mechanical actuator 180. Mechanical actuator 180 is rigidly attached to the back plate 185 of the antenna array 100 which is used for antenna array attachment.

Figures 1C, 2C:
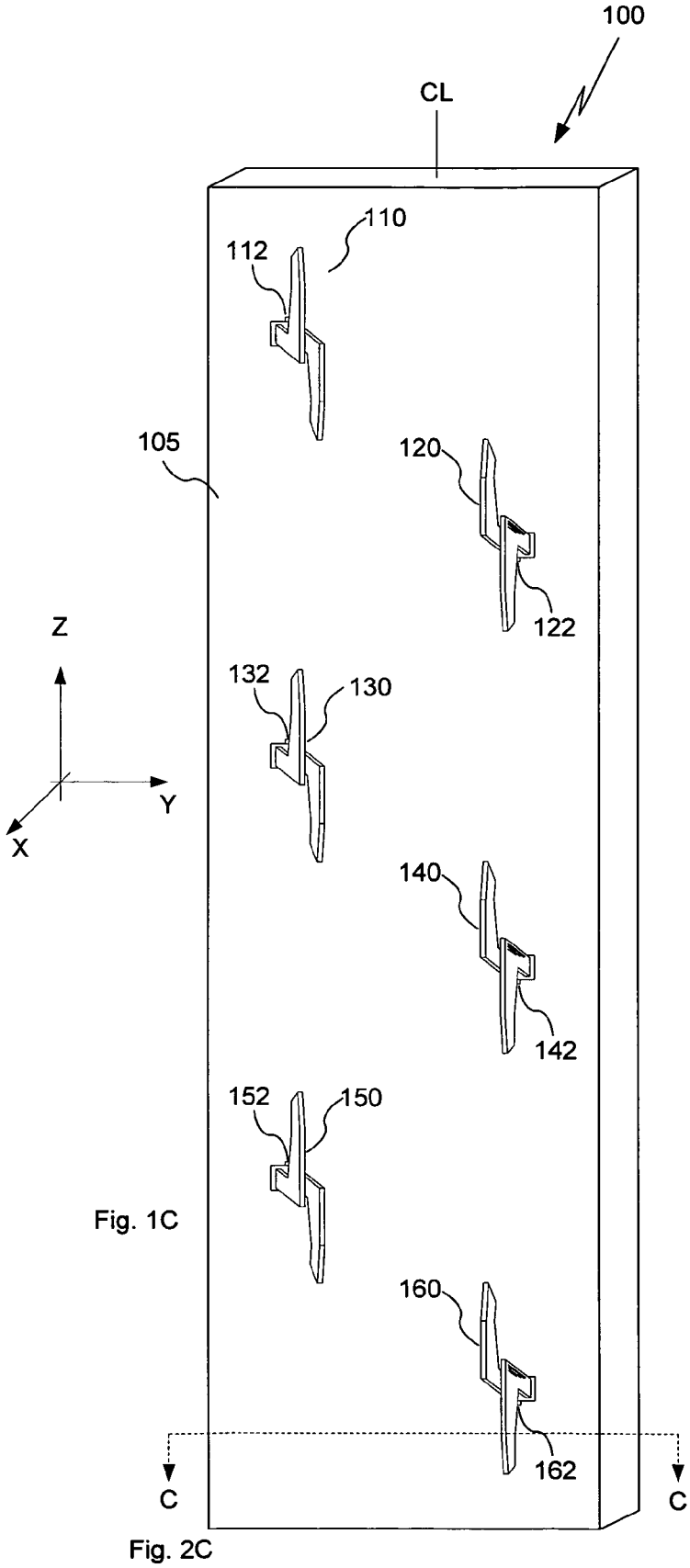
FIG. 1C illustrates a front view of a dual staggered vertically polarized antenna array in maximum azimuth beamwidth setting.
FIG. 2C illustrates a cross section along line C-C in Z-view of a dual staggered vertically polarized antenna array in maximally wide azimuth beamwidth setting.
Figure 2A:
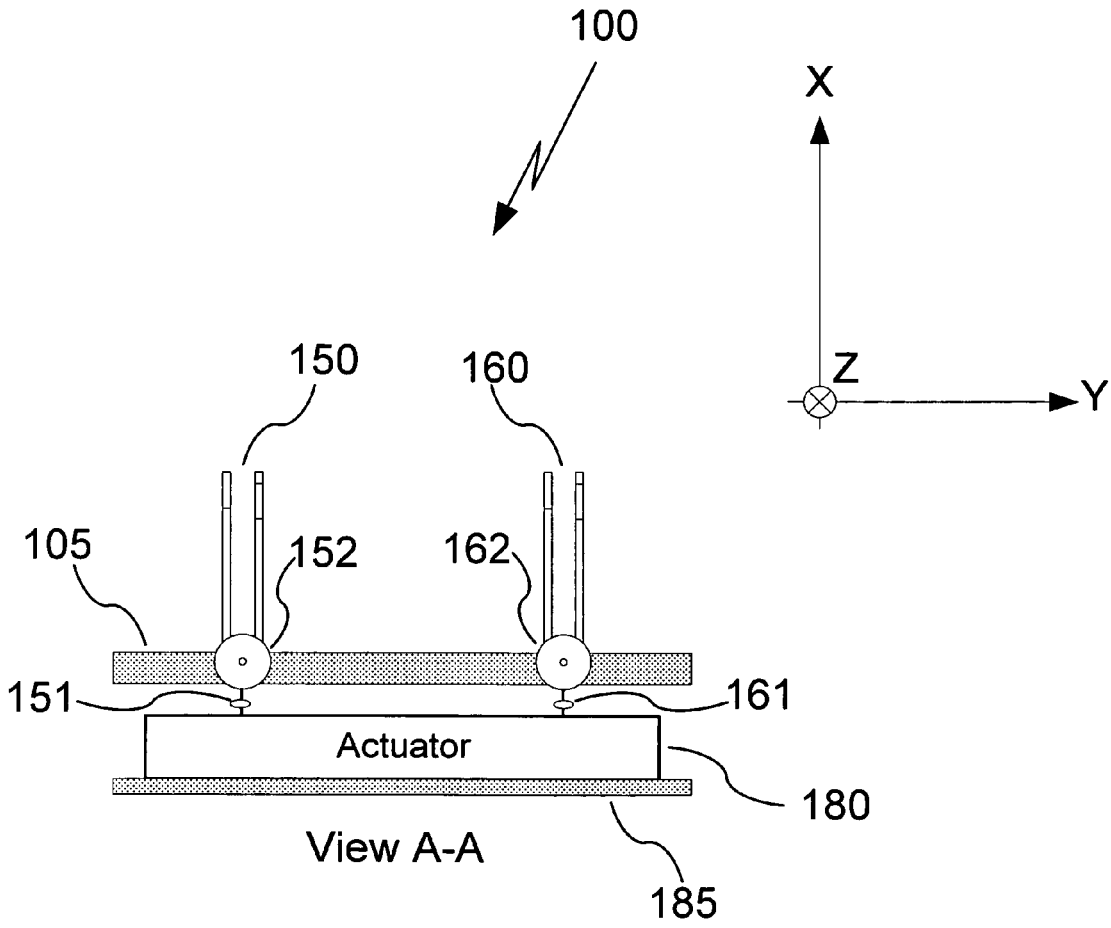
Figure 2B:
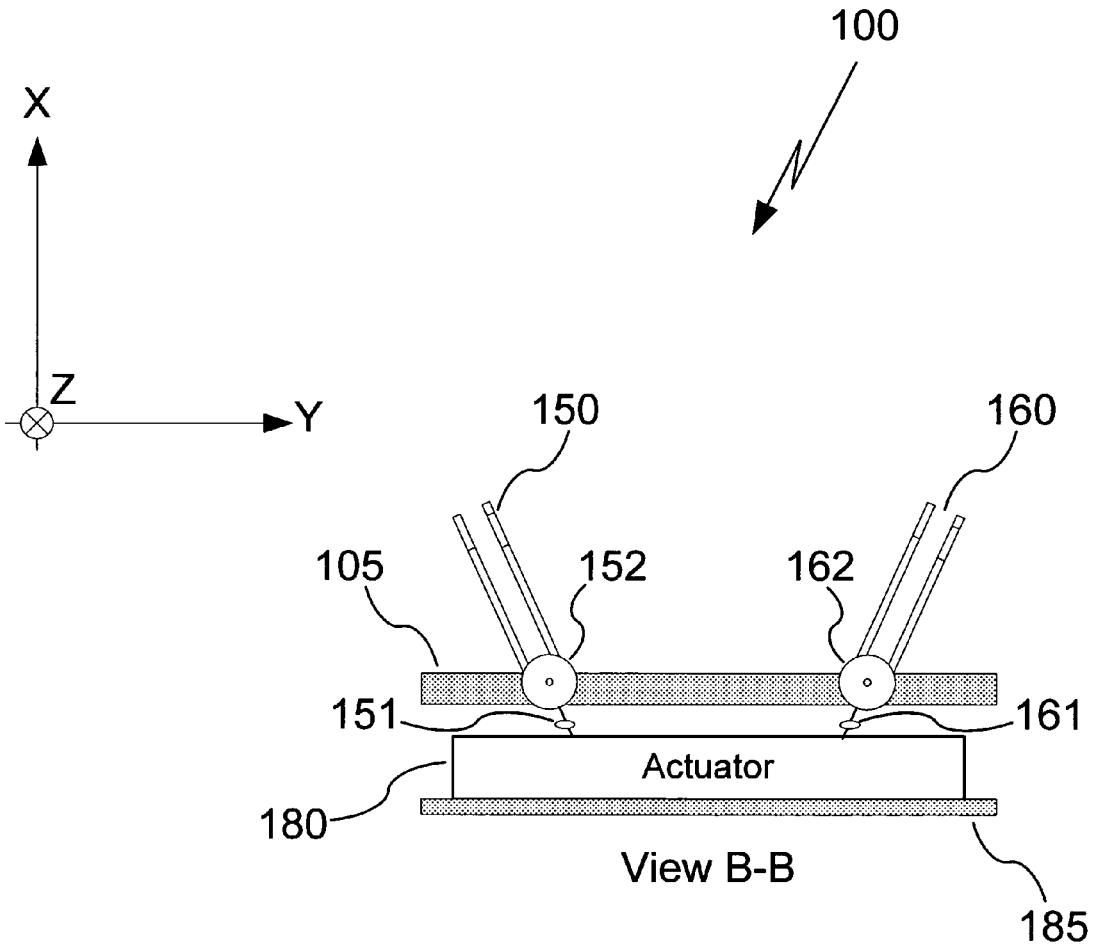
Figure 2C:
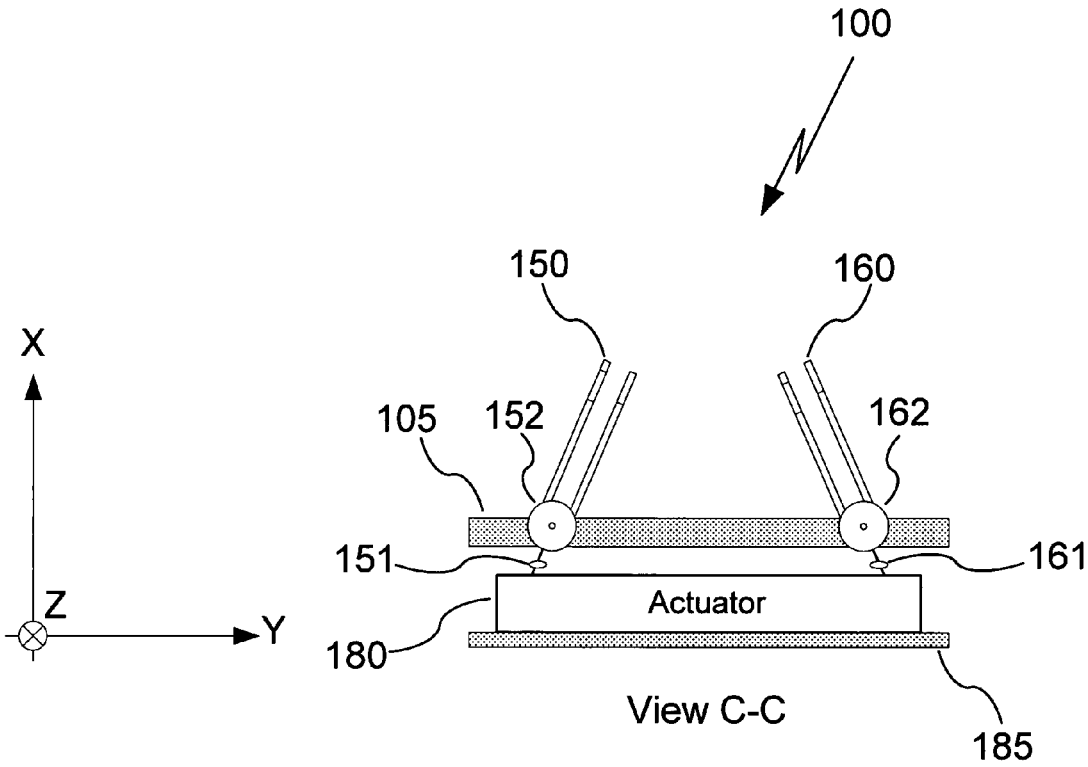

In particular with reference to FIG. 1C, each RF radiator (110, 120, 130, 140, 150, 160) element is mechanically attached to the reflector 105 plane with a corresponding, suitably constructed pivoting joint (112, 122, 132, 142, 152, 162) which allows for both positive and negative X-dimension declination relative to the reflector 105 plane aligned along the vertical axis (Z-axis). As shown in FIGS. 2A, 2B, and 2C, radiating element 150, 160 (and subsequently, the remainder of the radiating elements in the corresponding Group 1 and Group 2) X-axis angle relative to the reflector 105 plane, is altered via mechanical actuator couplings 151 and 161 mechanically controllable by actuator 180 (additional mechanical actuator couplings 111, 121, 131, 141 are not shown as they are obscured by the proceeding couplings but may be of identical construction).

Figure 4:
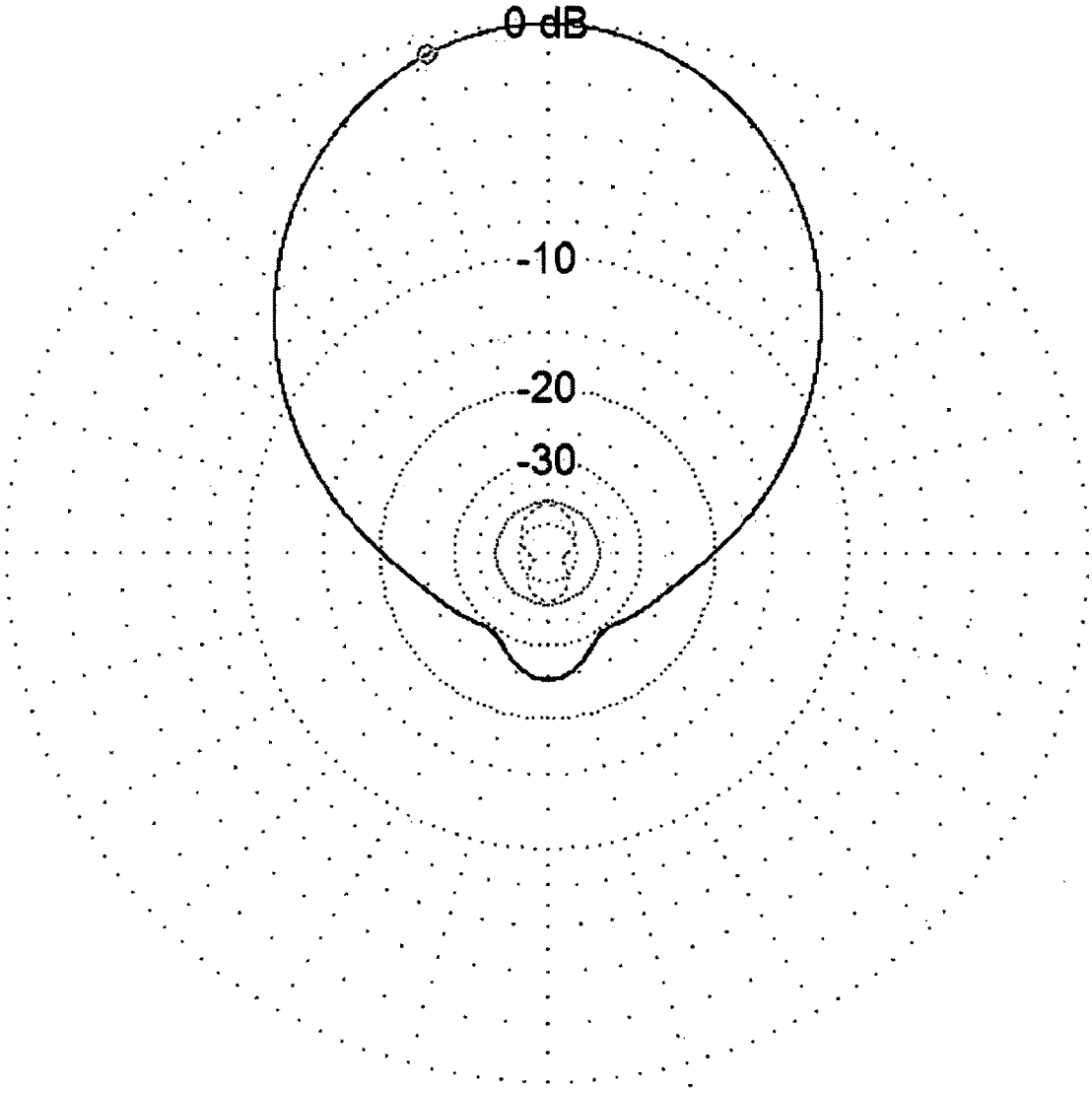
FIG. 4 illustrates a simulated azimuth radiation pattern of a dual staggered vertically polarized antenna array in wide azimuth beamwidth (corresponding to FIG. 2A configuration).

Consider the following three operational conditions (a-c):

Operating condition (a) wherein all RF radiators (110, 120, 130, 140, 150, and 160) are pivot aligned at 90 degrees relative to the reflector 105 plane. The pivot alignment angle is defined in counter clockwise direction from Y-axis reference pointing vector. FIG. 1A and FIG. 2A are representative of this setting. Such alignment setting will result in relatively wide azimuth beamwidth. FIG. 4 illustrates a simulated azimuth radiation pattern of a dual staggered vertically polarized antenna array in such a wide azimuth beamwidth.

Operating condition (b) wherein RF radiators (110, 120, 130, 140, 150, 160) are pivoted in the following configuration:

The RF radiators in Group 1, disposed along the G1 axis (110, 130, and 150) have their corresponding pivot alignment angle set to a value greater then 90 degrees, for example 100 deg, 100 deg, and 100 deg.

Figure 5:
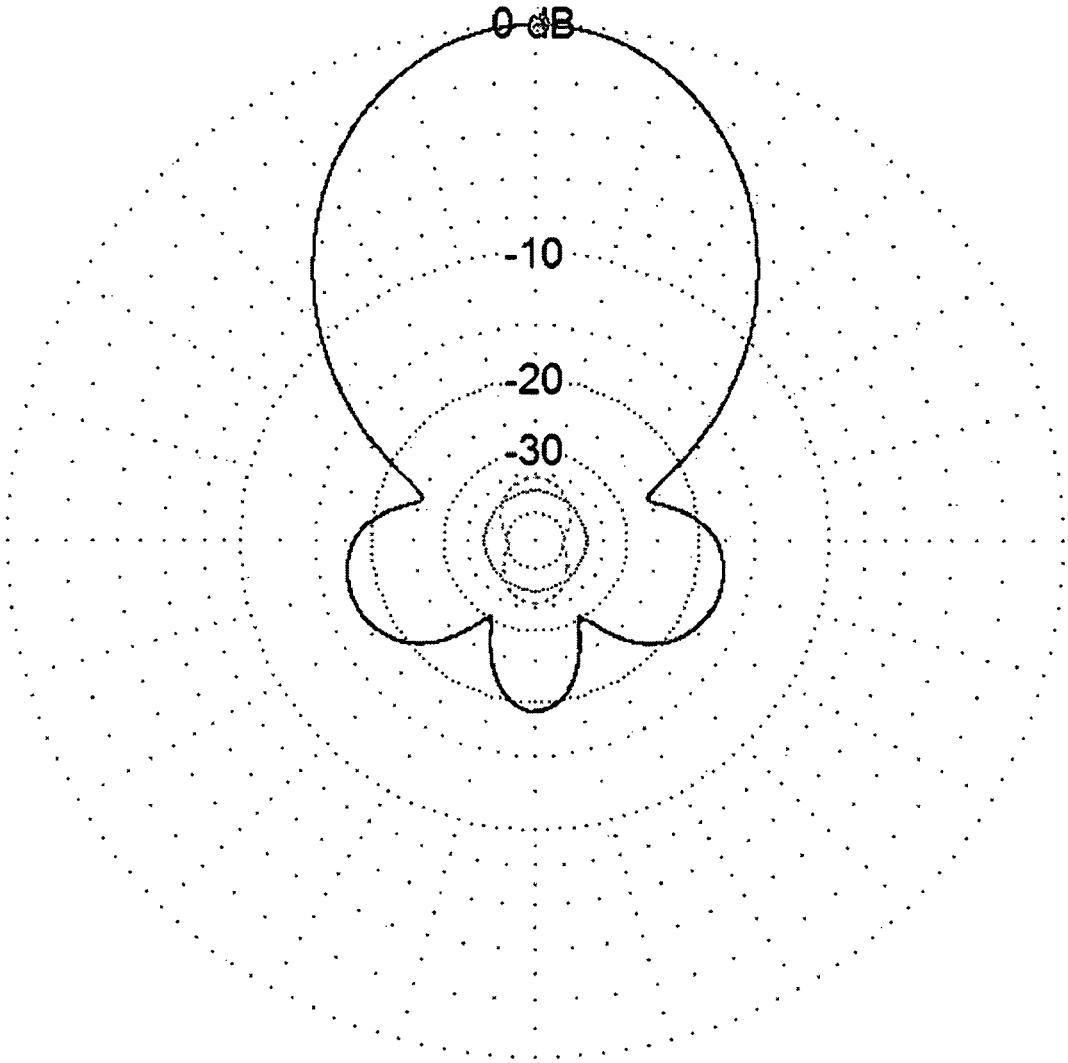
FIG. 5 illustrates a simulated azimuth radiation pattern of a dual staggered vertically polarized antenna array in narrow azimuth beamwidth (corresponding to FIG. 2B configuration).

Group 2 RF radiators, disposed along the G2 axis (120, 140, and 160) have their corresponding pivot alignment angle set to a value less then 90 degrees, for example 80 deg, 80 deg, and 80 deg. Once all RF radiators (110, 120, 130, 140, 150, 160) are configured to the above noted pivot alignment angles the resultant azimuth radiation will be narrower. FIG. 1B and FIG. 2B are representative of this operational setting. FIG. 5 illustrates a simulated azimuth radiation pattern of a dual staggered vertically polarized antenna array in such a narrow azimuth beamwidth.

Operating condition (c) wherein RF radiators (110, 120, 130, 140, 150, 160) are pivoted in the following configuration:

The RF radiators in Group 1, disposed along the G1 axis (110, 130, and 150) have their corresponding pivot alignment angle set to a value less then 90 degrees, for example 80 deg, 80 deg, and 80 deg.

Figure 6:
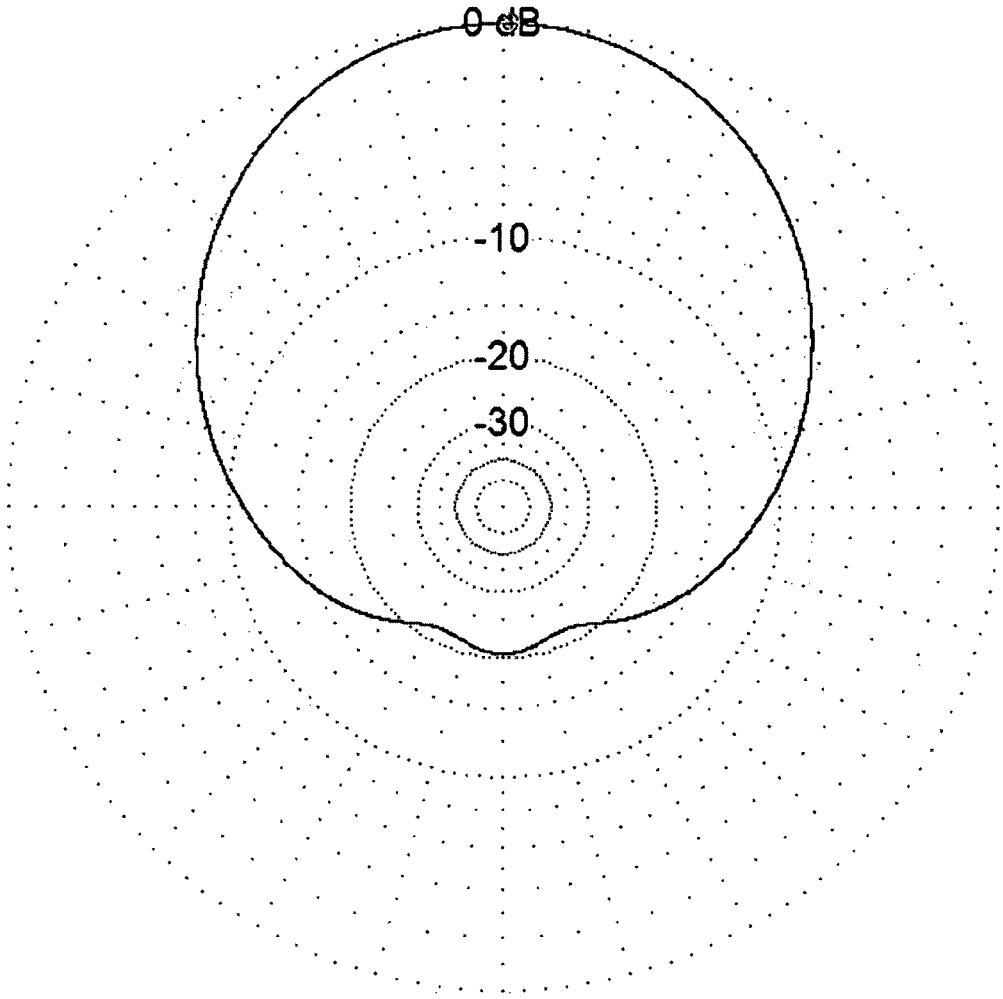
FIG. 6 illustrates a simulated azimuth radiation of a dual staggered vertically polarized antenna array in maximum azimuth beamwidth (corresponding to FIG. 2C configuration).

Group 2 RF radiators, disposed along G2 axis (120, 140, and 160) have their corresponding pivot alignment angle set to a value greater then 90 degrees, for example 100 deg, 100 deg, and 100 deg. Once RF radiators (110, 120, 130, 140, 150, 160) are configured to the above noted pivot alignment angles the resultant azimuth radiation will be substantially wider, but may experience overall gain drop. FIG. 1C and FIG. 2C are representative of this operational setting. FIG. 6 illustrates a simulated azimuth radiation of a dual staggered vertically polarized antenna array in such a maximum azimuth beamwidth.

Alternative operational settings maybe considered wherein some degree of azimuth beam steering control can be obtained in addition to azimuth beamwidth adjustment. Consider a pivot alignment angle setting wherein:

Group 1 RF radiators, disposed along the G1 axis (110, 130, and 150) have their corresponding pivot alignment angle set to a value slightly less then 90 degrees, for example 85 deg, 85 deg and 85 deg.

Group 2 RF radiators, disposed along the G2 axis (120, 140, and 160) have their corresponding pivot alignment angle set to a value less then 90 degrees, for example 75 deg, 75 deg and 75 deg. Resultant azimuth radiation will be skewed to the right of the boresight of the antenna with substantial azimuth pattern deformation and may result in undesired sidelobes. However such azimuth pattern deformations and sidelobe radiation can be corrected through other means known to those skilled in the art.

It will be appreciated from the foregoing that one embodiment of the invention includes a method for providing variable signal beamwidth by controlling angular settings of the two Groups of RF radiators relative to the reflector. As shown in FIGS. 2A, 2B, and 2C, radiating element 150, 160 (and subsequently, the remainder of the radiating elements in the corresponding Group 1 and Group 2) X-axis angle relative to the reflector 105 plane, is altered via mechanical actuator couplings 151 and 161 mechanically controllable by actuator 180. The radiators may therefore be first set to a first beamwidth setting by adjusting the first plurality of radiators (Group 1 radiators) to a first angle relative to the reflector and the second plurality of radiators (Group 2 radiators) to a second angle relative to the reflector by control of actuator 180. By way of example, any of one operating conditions (a), (b) or (c) may be used for the first beamwidth setting. The radiators may then be set to a second beamwidth setting by adjusting the first plurality of radiators (Group 1 radiators) to a third angle relative to the reflector and the second plurality of radiators (Group 2 radiators) to a fourth angle relative to the reflector by control of actuator 180. By way of example, any (different) one of operating conditions (a), (b) or (c) may be used for the second beamwidth setting.

The method of the invention may also provide variable beam tilt. In this embodiment of the invention, RF radiator (110, 120, 130, 140, 150, 160) elements are fed from a single RF input port, 210, with the same relative phase angle RF signal through a conventionally designed RF power signal dividing—combining network 190. RF power signal dividing—combining network 190 output ports are coupled 113, 123, 133, 143, 153, 163 to corresponding radiating elements 110, 120, 130, 140, 150, 160. Such RF power signal dividing—combining network 190 includes a remotely controllable phase shifting network so as to provide beam tilting capability, for example, as described in U.S. Pat. No. 5,949,303 assigned to current assignee and incorporated herein by reference. An example of such implementation is shown in FIG. 3B, wherein RF signal dividing—combining network 191 provides electrical down-tilt capability.

The phase shifting function of the RF power signal dividing—combining network 191 may be remotely controlled via multipurpose control port 200. Similarly, azimuth beamwidth control signals for beamwidth control may be coupled via multipurpose control port 200 to mechanical actuator 180.

Numerous modifications and alternative angular orientations and frequency ranges of operation of the above described illustrative embodiments will be apparent to those skilled in the art.

Reference Designator List

| Ref Des | Description |
|---|---|
| 100 | Vertical polarization dual stagger antenna array |
| 105 | Antenna Reflector |
| 110 | First Radiator Element (in this case a dipole) |
| 111 | First mechanical actuator coupling |
| 112 | First pivoting joint |
| 113 | First Radiator Element feed line to RF power dividing and combining network |
| 120 | Second Radiator Element (in this case a dipole) |
| 121 | Second mechanical actuator coupling |
| 122 | Second pivoting joint |
| 123 | Second Radiator Element feed line to RF power dividing and combining network |
| 130 | Third Radiator Element (in this case a dipole) |
| 131 | Third mechanical actuator coupling |
| 132 | Third pivoting joint |
| 133 | Third Radiator Element feed line to RF power dividing and combining network |
| 140 | Fourth Radiator Element (in this case a dipole) |
| 141 | Fourth mechanical actuator coupling |
| 142 | Fourth pivoting joint |
| 143 | Fourth Radiator Element feed line to RF power dividing and combining network |
| 150 | Fifth Radiator Element (in this case a dipole) |
| 151 | Fifth mechanical actuator coupling |
| 152 | Fifth pivoting joint |
| 153 | Fifth Radiator Element feed line to RF power dividing and combining |
| 160 | Sixth Radiator Element (in this case a dipole) |
| 161 | Sixth mechanical actuator coupling |
| 162 | Sixth pivoting joint |
| 163 | Sixth Radiating Element feed line to RF power dividing and combining |
| 180 | Mechanical Azimuth Actuator |
| 185 | Antenna back mounting plane |
| 190 | RF power dividing and combining network |
| 191 | RF power dividing and combining network with integrated remote electrical tilt capability |
| 200 | Multipurpose communication port |
| 210 | Common RF port |

What is claimed is:

1. An antenna for a wireless network, comprising:

a reflector;

a first plurality of radiators pivotally coupled along a first common axis and movable relative to the reflector; and a second plurality of radiators pivotally coupled along a second common axis and movable relative to the reflector;

wherein the first plurality of radiators and the second plurality of radiators are staggered relative to each other and are configurable at different angles relative to the reflector to provide variable signal beamwidth; and wherein the first and second plurality of radiators respectively comprise first and second radiator elements extending from the plane of the reflector and wherein the first and second plurality of radiators are configurable from a first setting with the first and second radiator elements oriented parallel to each other to a second setting with the elements nonparallel to each other.

2. The antenna of claim 1, wherein the first and second plurality of radiators comprise vertically polarized radiator elements.

3. The antenna of claim 2, further comprising a first plurality of actuator couplings coupled to the first plurality of radiators and a second plurality of actuator couplings coupled to the second plurality of radiators and at least one actuator coupled to the plurality of actuator couplings.

4. The antenna of claim 1, wherein the reflector is generally planar defined by a Y-axis, a Z-axis and an X-axis extending out of the plane of the reflector, and wherein the actuator is configured to adjust positive and negative X-axis orientation of the first plurality of radiators and the second plurality of radiators relative to the Z-axis of the reflector.

5. The antenna of claim 4, wherein the first plurality of radiators and the second plurality of radiators are each aligned vertically along their respective common axis at a predetermined distance in the range of $\frac{1}{2}\lambda$-$1\lambda$ from one another in said Z-axis direction of the reflector where $\lambda$ is the wavelength corresponding to the operational frequency of the antenna.

6. The antenna of claim 4, wherein the first common axis and second common axis are spaced apart at a predetermined distance in the range of 0-$\frac{1}{2}\lambda$ where $\lambda$ in said Y-axis direction of the reflector where $\lambda$ is the wavelength corresponding to the operational frequency of the antenna.

7. The antenna of claim 6, wherein the first plurality of radiators and the second plurality of radiators are vertically staggered at a predetermined distance in the range of ½λ-1λ from one another in said Z-axis direction of the reflector where λ is the wavelength corresponding to the operational frequency of the antenna, thereby defining a diagonal stagger distance between alternate first and second radiators.

8. The antenna of claim 4, wherein the first common axis and second common axis are spaced apart an equal distance from a center axis of the reflector.

9. The antenna of claim 1, wherein the first setting with the elements oriented parallel to each other has an orientation of the elements approximately 90 degrees to the plane of the reflector corresponding to a relatively wide beamwidth setting.

10. The antenna of claim 1, wherein the second setting with the elements oriented nonparallel to each other has an orientation of the elements away from each other corresponding to a relatively narrow beamwidth setting.

11. The antenna of claim 1, wherein the second setting with the elements oriented nonparallel to each other has an orientation of the elements approximately 20 degrees away from each other, or less, corresponding to 100 degrees and 80 degrees relative to the plane of the reflector, respectively.

12. The antenna of claim 1, wherein the second setting with the elements oriented nonparallel to each other has an orientation of the elements toward each other corresponding to a very wide beamwidth setting.

13. The antenna of claim 1, wherein the second setting with the elements oriented nonparallel to each other has an orientation of the elements approximately 20 degrees toward each other, or less, corresponding to 80 degrees and 100 degrees relative to the plane of the reflector, respectively.

14. The antenna of claim 1, wherein the first and second plurality of radiator elements are further configurable at different angles relative to the reflector to provide variable signal beam steering.

15. A method of adjusting signal beamwidth in a wireless antenna having a first plurality of radiators pivotally coupled along a first common axis relative to a reflector and a second plurality of radiators pivotally coupled along a second common axis relative to a reflector, comprising:

adjusting the first plurality of radiators to a first angle relative to the reflector and the second plurality of radiators to a second angle relative to the reflector to provide a first signal beamwidth; and adjusting the first plurality of radiators to a third angle relative to the reflector and the second plurality of radiators to a fourth angle relative to the reflector to provide a second signal beamwidth, wherein the first and second angles are equal and the third and fourth angles are different.

16. The method of claim 15, further comprising providing at least one beamwidth control signal for remotely controlling the angular setting of the first plurality of radiators and the second plurality of radiators.

17. The method of claim 15, wherein the first and second angles are approximately 90 degrees relative to the plane of the reflector and the third and fourth angles are greater and less than 90 degrees, respectively.

18. The method of claim 17, wherein the third and fourth angles are approximately 10 degrees greater and less than 90 degrees, respectively.

19. The method of claim 15, further comprising providing variable beam tilt by controlling the phase of the RF signals applied to the radiators through a remotely controllable phase shifting network.

* * * * *